US008069667B2

(12) United States Patent
Bellows

(10) Patent No.: US 8,069,667 B2
(45) Date of Patent: Dec. 6, 2011

(54) DEAERATOR APPARATUS IN A SUPERATMOSPHERIC CONDENSER SYSTEM

(75) Inventor: James C. Bellows, Maitland, FL (US)

(73) Assignee: Siemens Energy, Inc., Orlando, FL (US)

( * ) Notice: Subject to any disclaimer, the term of this patent is extended or adjusted under 35 U.S.C. 154(b) by 490 days.

(21) Appl. No.: 12/366,802

(22) Filed: Feb. 6, 2009

(65) Prior Publication Data

US 2010/0199671 A1 Aug. 12, 2010

(51) Int. Cl.
*F01K 17/00* (2006.01)

(52) U.S. Cl. ..... 60/686; 60/688

(58) Field of Classification Search ..... 60/685–690
See application file for complete search history.

(56) References Cited

U.S. PATENT DOCUMENTS 3,835,650 A * 9/1974 Chesmejef ..... 60/690
3,847,805 A 11/1974 Voedisch
4,251,219 A 2/1981 Larson et al.
4,383,046 A 5/1983 Emmett
4,644,479 A 2/1987 Kemper et al.
4,820,421 A 4/1989 Auerswald
4,857,202 A 8/1989 McNulty
5,389,261 A 2/1995 Daly et al.
RE35,741 E 3/1998 Oren et al.
5,746,971 A 5/1998 Millett et al.
5,779,814 A 7/1998 Fellers, Sr. et al.
5,829,255 A * 11/1998 Sitnyakovsky et al. ..... 60/688
5,873,238 A 2/1999 Bellows
5,904,039 A 5/1999 Bruckner et al.
6,089,013 A 7/2000 Bruckner et al.
6,237,321 B1 5/2001 Schmid et al.
6,343,570 B1 2/2002 Schmid et al.
6,363,711 B2 4/2002 Schmid et al.
6,619,042 B2 * 9/2003 Nadig ..... 60/688
6,755,023 B2 6/2004 Koenig et al.
6,823,674 B2 11/2004 Schwarzott
6,872,308 B1 3/2005 Bellows
7,065,970 B2 * 6/2006 Harpster ..... 60/685
7,306,653 B2 12/2007 Bellows et al.

* cited by examiner

*Primary Examiner* — Hoang M Nguyen

(57) ABSTRACT

A power generating system comprises a condenser and a deaerator apparatus. The condenser condenses a working fluid into a condensate and operates at an internal pressure above ambient pressure during a normal operating mode. The deaerator apparatus uses steam to remove contaminants from the condensate to bring the condensate to a desirable purity. The deaerator apparatus is deactivated during a typical operating state of the power generating system such that the condensate bypasses the deaerator apparatus. The deaerator apparatus is activated during a non-typical operating state of the power generating system such that the condensate passes into the deaerator apparatus wherein contaminants can be removed from the condensate. The typical operating state of the power generating system occurs when the condensate comprises a desirable purity and the non-typical operating state of the power generating system occurs when the condensate comprises an undesirable purity.

20 Claims, 3 Drawing Sheets

DEAERATOR APPARATUS IN A SUPERATMOSPHERIC CONDENSER SYSTEM

FIELD OF THE INVENTION

The present invention relates generally to power generating systems and, more particularly, to a deaerator apparatus that removes contaminants from condensate in power generating systems.

BACKGROUND OF THE INVENTION

In steam generating systems, a condenser is used downstream of a steam turbine to convert steam, after it has passed through the steam turbine, from its gaseous state to its liquid state. The condenser may be air-cooled and comprises a steam inlet duct, a plurality of condenser tubes, and a condensate outlet duct. Steam passes into the condenser through the steam inlet duct and flows through the condenser tubes. Air is forced over outer surfaces of the tubes so as to cool the tubes and, hence, the steam flowing through the tubes, thus causing the steam to be converted into a liquid condensate. The condensate is reused in generating steam for the steam turbine such that at least a portion of it later returns to the condenser where it is once again converted to its liquid state in the condenser.

It is desirable to prevent contaminants, such as oxygen and carbon dioxide, from entering the condenser. When the concentrations of oxygen and carbon dioxide are high enough, they become corrodents to iron and steel used in the condenser and other components of the steam generating system, including piping and a steam generator. The corrosion product is iron oxide which tends to deposit on the steam generator surfaces and reduce heat transfer. Corrosion also causes wall thinning of the condenser tubes and other steel structures, and can result in leaks and failures. In addition to being a corrodent, carbon dioxide interferes with monitoring of the steam generating system for more corrosive species, such as chloride. Hence, carbon dioxide is a nuisance that may require the steam generating system to use more sophisticated monitoring equipment at significantly greater expense.

Despite attempts to prevent the leakage of contaminants into steam generating systems, during certain operating conditions of the steam generating systems, some leakage may occur. For example, the normal operating pressure in a typical condenser may be a few inches of mercury (absolute pressure) and, hence, the normal operating pressure is at a vacuum, i.e., less than 1 atmosphere absolute pressure, in which case contaminants may leak into the condenser. Further, contaminants may leak into the condenser of a steam generating system when the system is stopped or slowed, such as during shut-down phase of the system. Additionally, various maintenance procedures that may be performed during the system shut-down phase require that one or more of the components of the steam generating system be filled with air, i.e., so that a human may enter into the component to perform maintenance thereto.

Condensate polishers and/or deaerators are known to remove contaminants from the condensate. However, as noted above, the normal operating pressure within a typical condenser in a power generating system is below one atmosphere, and thus, contaminants are susceptible to leak into the condenser. Thus, the condensate polishers/deaerators used to remove contaminants from the condensate may be continually run during operation of the power generating system, thus increasing a cost and/or decreasing an efficiency of the power generating system.

SUMMARY OF THE INVENTION

In accordance with one aspect of the present invention, a power generating system is provided. The power generating system comprises a condenser and a condensate treating apparatus. The condenser receives steam or a combination of water and steam and condenses the steam or combination of water and steam into a condensate. The condenser operates at an internal pressure above ambient pressure during a normal operating mode of the condenser. The condensate treating apparatus removes contaminants from the condensate to bring the condensate to a desirable purity. The condensate treating apparatus is deactivated during a typical operating state of the power generating system such that the condensate bypasses the condensate treating apparatus. The condensate treating apparatus is activated during a non-typical operating state of the power generating system such that the condensate passes into the condensate treating apparatus wherein contaminants can be removed from the condensate. The typical operating state of the power generating system occurs when the condensate comprises the desirable purity and the non-typical operating state of the power generating system occurs when the condensate comprises an undesirable purity. During a time in which the condenser operates in the normal operating mode at the internal pressure above ambient pressure, the power generating system operates in the non-typical operating state a first portion of the time and operates in the typical operating state a second portion of the time.

In accordance with one aspect of the present invention, a power generating system is provided. The power generating system comprises a steam source, a steam turbine, a condenser, and a deaerator apparatus. The condenser receives steam or a combination of water and steam and condenses the steam or combination of water and steam into a condensate. The condenser operates at an internal pressure above ambient pressure during a normal operating mode of the condenser. The deaerator apparatus uses steam from at least one of the steam source and the steam turbine to remove contaminants from the condensate to bring the condensate to a desirable purity. The deaerator apparatus is deactivated during a typical operating state of the power generating system such that the condensate bypasses the deaerator apparatus. The deaerator apparatus is activated during a non-typical operating state of the power generating system such that the condensate passes into the deaerator apparatus wherein contaminants can be removed from the condensate. The typical operating state of the power generating system occurs when the condensate comprises a desirable purity and the non-typical operating state of the power generating system occurs when the condensate comprises an undesirable purity. During a time in which the condenser operates in the normal operating mode at the internal pressure above ambient pressure, the power generating system operates in the non-typical operating state a first portion of the time and operates in the typical operating state a second portion of the time.

In accordance with yet another aspect of the present invention, a method is provided of treating condensate that has been condensed in a condenser adapted for use within a steam generating system including a working fluid circuit. The condenser operates at an internal pressure above ambient pressure during a normal operating mode of the condenser. The condensate bypasses a condensate treating apparatus during a typical operating state of the steam generating system, the typical operating state occurring when the condensate comprises a desirable purity. The condensate is passed through the condensate treating apparatus during a non-typical operating state of the steam generating system, the non-typical operating state occurring when the condensate comprises an undesirable purity. The condensate is passed into the condensate treating apparatus. Contaminants are removed from the condensate. The condensate is passed out of the condensate treating apparatus. A purity of the condensate is measured after contaminants have been removed therefrom by the condensate treating apparatus. The condensate is continually through the condensate treating apparatus until the condensate comprises a desirable purity.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
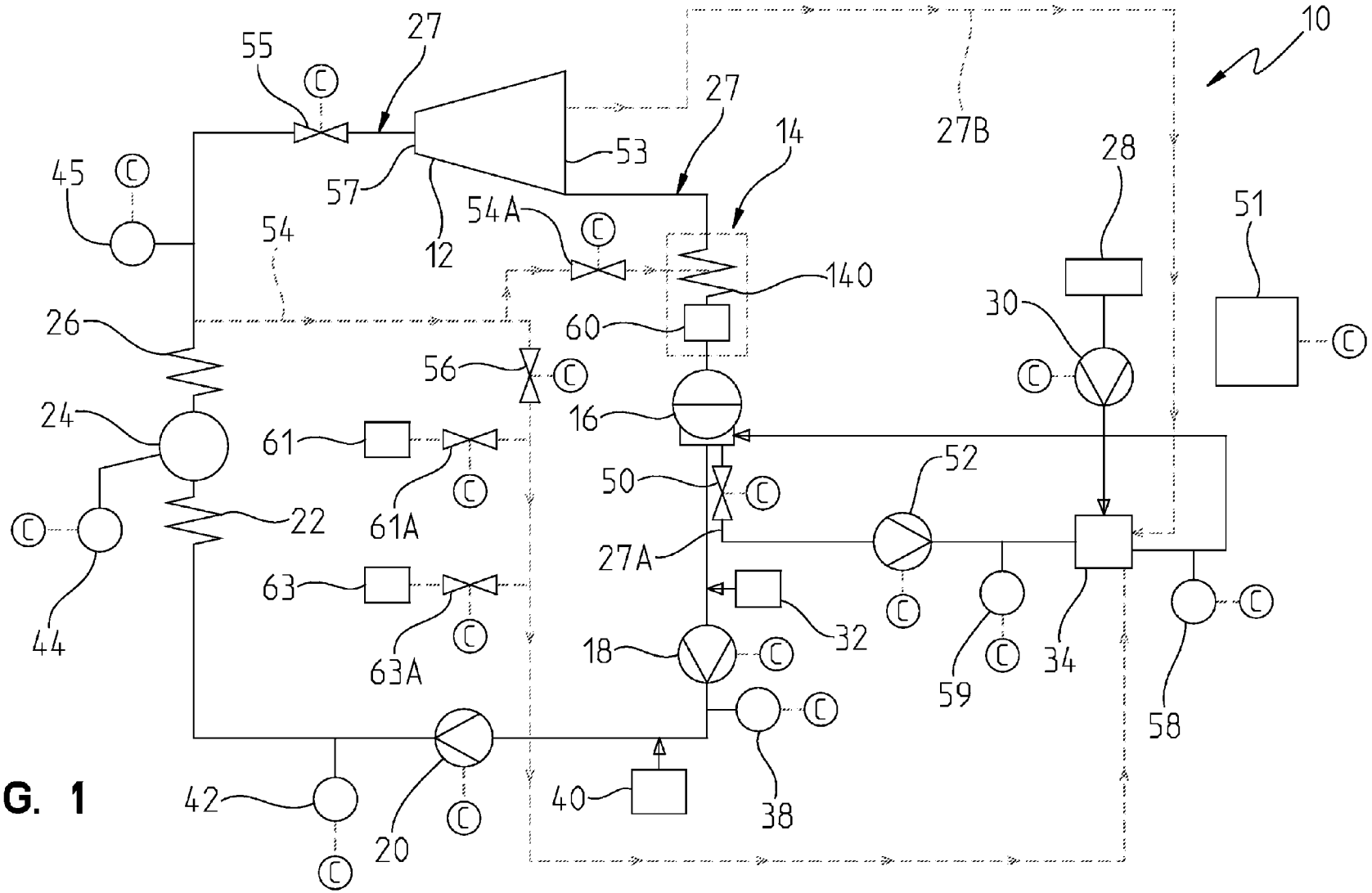
FIG. 1 is a diagrammatic illustration of a steam generating system in accordance with an embodiment of the invention.

Referring to FIG. 1, an exemplary steam generating system 10 including a working fluid circuit constructed in accordance with an embodiment of the present invention is schematically shown. The working fluid circuit of the steam generating system 10 comprises (moving clockwise in FIG. 1 starting from the top) a steam turbine 12, a condenser system 14 including a condenser 140 and a pressure maintenance apparatus 60, a condensate receiver tank 16, a first pump 18, a second pump 20, a condensate preheater or economizer 22, a drum 24 having an associated evaporator (not shown), and a super heater 26. The components are in fluid communication via conduits 27 that extend between adjacent components. As used herein, the term fluid may refer to any liquid, gas, or any combination thereof.

During operation, a working fluid comprising water and steam is cycled through the working fluid circuit such that pressurized steam provided to the steam turbine 12 causes a rotor within the steam turbine 12 to rotate. The working fluid exits the steam turbine 12 and is conveyed into the condenser system 14. One condenser system that may be used is disclosed in U.S. patent application Ser. No. 12/366,763, entitled CONDENSER SYSTEM, filed concurrently with this patent application, the entire disclosure of which is incorporated herein by reference. In the condenser system 14, the enthalpy of the working fluid is lowered such that the working fluid is substantially converted into (liquid) condensate.

The condensate, which may have a temperature above about 50° Celsius, e.g., about 100° Celsius, then exits the condenser system 14 and flows into the condensate receiver tank 16. The condensate receiver tank 16 may act as a collection tank for the condensate. After exiting the condensate receiver tank 16, controlled quantities of oxygen may be provided to the condensate via an oxygen source 32 to promote a dense, protective hematite or magnetite passive layer on structure forming part of the steam generating system 10 in a process that will be apparent to those skilled in the art.

In the embodiment shown, a condensate treating device, illustrated in FIG. 1 as a deaerator apparatus 34, is branched off from the working fluid circuit, e.g., at the condensate receiver tank 16. It is understood that other types of condensate treating devices, such as a condensate polisher circuit (not shown), could be used in place of the deaerator. A configuration of a steam generating system incorporating a condensate polisher circuit is disclosed U.S. patent application Ser. No. 12/366,738, entitled CONDENSATE POLISHER CIRCUIT, filed concurrently with this patent application, the entire disclosure of which is incorporated herein by reference. Additional details in connection with the deaerator apparatus 34 will be discussed below.

Any desired make-up water is provided from a demineralized water storage tank 28 so as to compensate for any working fluid losses that may have occurred within the steam generating system 10. Depending on the particular configuration of a given steam generating system, the amount of make-up water that is used to compensate for working fluid loss within the steam generating system 10 may vary. For example, in the steam generating system 10, typically about 5% of the working fluid may be lost, e.g. vented off or blown down, such that about 5% of the working fluid may be added back in from the demineralized water storage tank 28. It is noted that during a power augmentation operating mode of the steam generating system 10, up to about 20-35% of the working fluid may be lost, e.g. sent to a combustion turbine (not shown), such that about 20-35% of the working fluid may be added back in from the demineralized water storage tank 28.

In the embodiment shown, the make-up water is pumped by a third pump 30 and sprayed into the deaerator apparatus 34. However, the make-up water may be passed directly into the working fluid circuit downstream from the steam turbine 12, e.g., between the steam turbine 12 and the condenser system 14, or into the condensate receiver tank 16.

A condensate sample point 38 is located between the first and second pumps 18, 20 where the cation conductivity, oxygen, sodium, and silica of the condensate can be measured. One or more of the cation conductivity, oxygen, sodium, and silica define the purity of the condensate. If the purity is found to be out of specification, measures can be taken to correct the problem as will be discussed below.

Ammonia ($NH_3$) may then be introduced into the condensate from a source of ammonia 40 located between the condensate sample point 38 and the second pump 20. The ammonia is introduced to raise the pH of the condensate, preferably to a pH of about 9. Once the ammonia is introduced into the condensate, the condensate is typically referred to as feed water, which feed water is sampled at a feed water sample point 42 and then fed into the economizer 22. At the feed water sample point 42, the specific conductivity, cation conductivity, pH, oxygen, sodium, iron, copper, and total organic carbon (TOC) of the feed water can be measured.

It is noted that, in a preferred embodiment, the pH of the working fluid is maintained slightly above a lower limit of a normal operating range for the pH level of the working fluid, such that contaminants can more easily be removed from the working fluid, i.e., the lower the pH of the working fluid, the easier it is to remove contaminants therefrom. For example, the lower the pH, the more associated contaminants, such as carbon dioxide, are to the working fluid, i.e., the contaminants are less ionized, such that the contaminants can be more easily separated from the working fluid. For example, at high pH, carbon dioxide is converted to bicarbonate and carbonate, which are relatively non-volatile. However, at lower pH, the dominant form is carbon dioxide, which is volatile. At intermediate pH, the carbon dioxide is a mixture of bicarbonate and carbon dioxide. Only volatile materials are removed in the deaerator apparatus 34, so increasing the fraction that is in the carbon dioxide form enhances the removal thereof by the deaerator apparatus 34. The same tendency holds true for any acid that can be partially associated in the liquid phase. One or more of the specific conductivity, cation conductivity, pH, oxygen, sodium, iron, copper, and total organic carbon (TOC) define the purity of the feed water. If the purity is found to be out of specification, measures can be taken to correct the problem as will be discussed below.

The feed water is then fed into the economizer 22 where the feed water is heated to a few degrees below a saturation temperature defined by the steam generator pressure. For example, a 125 barg boiler may have a saturation temperature of 328° C. and a final feed water temperature of about 325° C.

The heated feed water is then conveyed from the economizer 22 into the drum 24 wherein the feed water is typically referred to as drum water. A drum water sample point 44 is associated with the drum 24 where the cation conductivity, pH, sodium, silica, and iron of the drum water can be measured. One or more of the cation conductivity, pH, sodium, silica, and iron define the purity of the drum water. If the purity is found to be out of specification, measures can be taken to correct the problem as will be discussed below. The drum water is cycled though the evaporator, which converts part of the drum water into steam. The mixture of steam and water rises to the top of the evaporator and into the drum 24 where the steam is separated from the water. The separated water remains in the drum 24 and is recirculated to the evaporator and the steam passes into the super heater 26 wherein the temperature of the steam is increased to about 450 to 550° C.

The superheated steam is then sampled at a superheated steam sample point 45 where the cation conductivity, sodium, silica, and iron of the superheated steam are measured. One or more of the cation conductivity, sodium, silica, and iron define the purity of the superheated steam. If the purity is found to be out of specification, measures can be taken to correct the problem as will be discussed below. The superheated steam is then conveyed into the steam turbine 12. As the superheated steam passes through the steam turbine 12, energy is removed from the steam and the steam exits the steam turbine 12 where it is again conveyed into the condenser system 14 for a subsequent cycle through steam generating system 10.

During a normal operating mode of the condenser 140, its internal pressure is equal to or greater than a predefined pressure. The predefined pressure may be ambient pressure, i.e., the pressure on the outside of the condenser 140, typically 1 atmosphere (normal atmospheric pressure). During a non-normal operating mode of the condenser 140, its internal pressure is less than the predefined pressure. A non-normal operating mode of the condenser 140 may occur when the steam generating system 10 is shut down or the steam generating system 10 is operating at a reduced-load wherein a shut-down sequence has commenced but the steam generating system 10 has not completely shut-down. Hence, during a non-normal operating mode of the condenser 140, the amount of working fluid entering the condenser 140 from the conduit 27 may be reduced (i.e., during reduced-load operation) or null (i.e., during steam generating system shut down). Hence, the amount of working fluid entering the condenser 140 from the conduit 27 may not be sufficient to maintain pressure in the condenser 140 equal to or above the predefined pressure, i.e., ambient pressure.

If the pressure within the condenser 140 falls below the ambient pressure, air or other contaminants, e.g., oxygen or carbon dioxide, may leak into the condenser 140, which is undesirable. The condenser 140 and other heat transfer components in the steam generating system 10 may be partially formed from iron, which may become corroded by high concentrations of oxygen and carbon dioxide. Specifically, a corrosion product, e.g., iron oxide, tends to deposit on the surfaces of the condenser system 14 and other heat transfer components in the steam generating system 10 that are formed at least partially from iron. The iron oxide is undesirable on the surfaces of these components as it reduces heat transfer. Further, corrosion may also cause wall thinning of condenser components and other structures within the steam generating system 10, which can result in leaks and failures.

Moreover, the carbon dioxide from the air may interfere with monitoring of the steam generating system 10. For example, carbon dioxide and chloride (a highly detrimental chemical species if leaked in the steam generating system 10) are both known to cause an increase in the cation conductivity of the working fluid flowing through the steam generating system 10. As the cation conductivity is measured at one or more of the sample points 38, 42, 44, 45 the high carbon dioxide may mask any indication for chloride in the steam generating system 10, i.e., the heightened cation conductivity due to high or increased chloride cannot be noticed due to the high cation conductivity caused by the carbon dioxide. Given that chloride is a highly detrimental species to have in the steam generating system 10, such masking of the chloride is very undesirable.

The pressure maintenance apparatus 60 may be employed in the steam generating system 10 to maintain the pressure within the condenser 140 equal to or greater than the predefined pressure during normal and non-normal operating modes of the steam generating system 10. The pressure maintenance apparatus 60 substantially prevents air and other contaminants from entering the condenser 140 during normal and non-normal operating modes of the condenser 140 by maintaining the pressure within the condenser 140 equal to or above the pressure on the outside of the condenser 140. Accordingly, damage to the components of the steam generating system 10 associated with corrodents resulting from the air, and also the monitoring problems described above associated with the carbon dioxide in the air, are substantially avoided. Additional details in connection with the pressure maintenance apparatus 60 can be found in the above-referenced U.S. patent application Ser. No. 12/366,763, entitled CONDENSER SYSTEM, filed concurrently with this patent application.

As discussed above, the pressure maintenance apparatus 60 prevents air and other contaminants from entering the condenser 140 during normal and non-normal operating modes of the condenser 140 by maintaining the pressure within the condenser 140 equal to or above the pressure on the outside of the condenser 140. However, under certain circumstances, air and/or other contaminants may enter into the condenser 140 and/or other components of the steam generating system 10, which contaminants may dissolve into the condensate. For example, certain maintenance procedures may necessitate that the condenser 140 be filled with air, i.e., such that a human may enter the condenser 140 to perform the maintenance procedure(s). Filling the condenser 140 with air may cause the amount of contaminants in the condensate to become too high for preferred operation of the steam generating system 10. In which case, all or some of the contaminants must be removed from the condensate to bring the condensate to an acceptable purity such that a typical operating state of the steam generating system 10 may take place.

The typical operating state of the steam generating system 10 may be defined, for example, when the working fluid (condensate, make-up water, feed water, drum water, steam, superheated steam) comprises a desirable purity, as measured at one or more of the sample points 38, 42, 44, 45. During the typical operating state, a first valve 50, which may be located, for example, in a section of conduit 27A branched off from the condensate receiver tank 16, is closed, such that the condensate bypasses the deaerator apparatus 34 and is pumped by the first and second pumps 18, 20 and passed through the remainder of the working fluid circuit. It is noted that, while the deaerator apparatus 34 is shown as branched off of the condensate receiver tank 16 in FIG. 1, the deaerator apparatus 34 may be associated with other structures associated with the condenser 140, such as, for example, the condenser 140 itself or downstream from the condenser 140, e.g., between the first and second pumps 18, 20. It is also noted that, although the deaerator apparatus 34 is illustrated in FIG. 1 as being branched off from a lower portion of the condensate receiver tank 16, the illustration is not intended to limit the deaerator apparatus 34 to being branched off from any particular portion of the condensate receiver tank 16, i.e., the deaerator apparatus 34 may be branched off from any portion of the condensate receiver tank 16 from which a liquid, e.g., condensate, is available.

However, during a non-typical operating state of the steam generating system 10, which may be defined, for example, when the working fluid (condensate, make-up water, feed water, drum water, steam, superheated steam) comprises an undesirable purity, as measured at one or more of the sample points 38, 42, 44, 45, the first valve 50 is opened. Additionally, the first and second pumps 18, 20 may be deactivated, depending on the measured purity of the condensate. For example, if the condensate is extremely contaminated, i.e., during a first type of a non-typical operating state of the steam generating system 10, the first and second pumps 18, 20 may be deactivated such that the condensate is substantially prevented from passing through the first and second pumps 18, 20 and on through the remainder of the working fluid circuit. Alternatively, if the condensate comprises an undesirable purity but is not extremely contaminated, i.e., during a second type of a non-typical operating state of the steam generating system 10, the first and second pumps 18, 20 may remain activated such that a portion of the condensate passes through the first and second pumps 18, 20 and on through the remainder of the working fluid circuit.

During the first type of the non-typical operating state of the steam generating system 10 according to this embodiment, a fourth pump 52 disposed in the section of conduit 27A, which may be a dedicated deaerator apparatus pump, is activated. The fourth pump 52 pumps the condensate from the condensate receiver tank 16 through the first valve 50 and into the deaerator apparatus 34. The first valve 50, the pumps 18, 20, 30, 52, and the deaerator apparatus 34 may be controlled, for example, by a controller 51. The controller 51 may be in communication with one or more of the sample points 38, 42, 44, 45 for receiving measurements from the one or more of the sample points 38, 42, 44, 45 and controlling the opening and closing of the first valve 50 and the activation/deactivation of the pumps 18, 20, 30, 52 and deaerator apparatus 34 based on the received measurements. It is noted that communication of a component with the controller 51 in FIG. 1 is represented by dashed line connected to a circle that surrounds the letter C.

The deaerator apparatus 34 may comprise, for example, a spray-tray deaerator, a spray deaerator, a tray deaerator, or a spray-scrubber deaerator, and removes contaminants from the condensate in a manner that will be apparent to those skilled in the art. One such spray-tray deaerator that can be utilized is disclosed in commonly owned U.S. patent application Ser. No. 12/366,716, entitled POWER GENERATING PLANT HAVING INERT GAS DEAERATOR AND ASSOCIATED METHODS, filed concurrently with this patent application, the entire disclosure of which is incorporated herein by reference.

It is noted that during the first type of the non-typical operating state of the steam generating system 10, steam, for example from an outlet 53 of the steam turbine 12, may be conveyed through a section of conduit 27B to provide deaeration of the condensate in the deaerator apparatus 34, although it is understood that steam from other sources could be used, some of which will be described below, e.g., from the super heater 26 or from an auxiliary boiler 61. To remove contaminants from the condensate in the exemplary deaerator apparatus 34, the steam warms the condensate and provides a vaporous sweep through the deaerator apparatus 34. Eventually, the temperature of the condensate approaches and may equal the temperature of the steam. At this point, the amount of steam condensed in the deaerator apparatus 34 approaches zero. However, some of the steam is vented to allow a sweep of the steam (in vapor phase) over the condensate to remove contaminants from the condensate.

During the second type of the non-typical operating state of the steam generating system 10, the first valve 50 is opened and the first and second pumps 18, 20 remain activated. Thus, the condensate continues to pass through the first and second pumps 18, 20 and on through the remainder of the working fluid circuit. However, during the second type of the non-typical operating state of the steam generating system 10, the steam turbine 12 may be activated or deactivated and a second valve 55 located upstream from the steam turbine 12 may be opened or closed, i.e., by the controller 51, to permit/prevent the flow of the superheated steam into the steam turbine 12. The steam turbine 12 may be activated/deactivated and the second valve 55 may be opened/closed depending on, for example, the purity of the condensate and the desired efficiency of the steam turbine 12. Further, a steam turbine circumvent circuit 54 may be utilized to pass at least a portion of steam from a steam source, e.g., from the super heater 26 as illustrated in FIG. 1, through a steam turbine circumvent valve 56, which may be opened by the controller 51, wherein the portion of the steam circumvents the steam turbine 12. A first portion of the steam passing through the steam turbine circumvent circuit 54 may flow through a third valve 54A and pass into the condenser 140, and a second portion of the steam passing through the steam turbine circumvent circuit 54 may flow into the deaerator apparatus 34 for removing contaminants from the condensate in the deaerator apparatus 34. The third valve 54A, and correspondingly the amount of the first and second portions of the steam, may be controlled, for example, by the controller 51.

It is understood that the steam may be from a steam source other than the super heater 26, such as, for example, the evaporator or a separate steam source, such as, for example, the auxiliary boiler 61. A fourth valve 61A may be opened/ closed, i.e., by the controller 51 to permit/prevent the flow of steam from the auxiliary boiler 61 into the circumvent circuit 54 and into the deaerator apparatus 34. It is also understood that the steam turbine circumvent circuit 54, while being branched off from just downstream from the super heater 26 as shown in FIG. 1, may be branched off from other locations downstream from where the drum water is evaporated to steam, such as, for example, from a location adjacent to an inlet 57 of the steam turbine 12.

An inert gas source 63 may provide an inert gas, e.g., nitrogen, into the circumvent circuit 54. A fifth valve 63A may be opened/closed, i.e., by the controller 51 to permit/prevent the flow of the inert gas from the inert gas source 63 into the circumvent circuit 54 and into the deaerator apparatus 34. The inert gas may be used to decrease a time needed to remove contaminants from the condensate in the deaerator apparatus 34. Additional details in connection with the removal of contaminants from a deaerator using an inert gas can be found in the above-referenced U.S. patent application Ser. No. 12/366,716, entitled POWER GENERATING PLANT HAVING INERT GAS DEAERATOR AND ASSOCIATED METHODS, filed concurrently with this patent application During the second type of the non-typical operating state of the steam generating system 10 according to this embodiment, the fourth pump 52 pumps the condensate from the condensate receiver tank 16 through the first valve 50 and into the deaerator apparatus 34. Further, the components of the steam generating system 10, and optionally the steam turbine 12 as discussed above, continue to run such that drum water is evaporated in the evaporator and superheated in the super heater 26. The valves 50, 54A, 55, 56, 61A, 63A, the pumps 18, 20, 30, 52, and the deaerator apparatus 34 may be controlled, for example, by the controller 51. The controller 51 may be in communication with one or more of the sample points 38, 42, 44, 45 for receiving measurements from the one or more of the sample points 38, 42, 44, 45 and controlling the opening and closing of the valves 50, 54A, 55, 56, 61A, 63A and the activation/deactivation of the pumps 18, 20, 30, 52 and the deaerator apparatus 34 based on the received measurements.

It is noted that during the second type of the non-typical operating state of the steam generating system 10, steam, for example from the super heater 26 or from the auxiliary boiler 61 via the steam turbine circumvent circuit 54, may be used to provide deaeration of the condensate in the deaerator apparatus 34, although it is understood that steam from other sources could be used. For example, if the steam turbine 12 remains activated during the second type of the non-typical operating state of the steam generating system 10, steam may be introduced from the steam turbine 12 via the section of conduit 27B instead of or in addition to the steam from the steam turbine circumvent circuit 54 to provide deaeration of the condensate in the deaerator apparatus 34.

Once the condensate exits the deaerator apparatus 34, the condensate may be sampled at a deaerator apparatus sample point 58 and then conveyed back into the condensate receiver tank 16. At the deaerator apparatus sample point 58, the specific conductivity, sodium, and silica of the condensate, one or more of which defining the purity of the condensate, may be measured, for example. If any of the measured properties are found to be out of specification, appropriate measures can be taken to correct the problem, e.g., the condensate may be cycled again through the deaerator apparatus 34. It is noted that the condensate may be cycled through the deaerator apparatus 34 several times until the condensate comprises a desirable purity. It is further noted that in a preferred embodiment, the deaerator apparatus 34 is capable of circulating up to about 20-35% of the working fluid therethrough, although it is understood that the deaerator apparatus 34 may be capable of circulating a larger percentage of the working fluid therethrough. The capacity of the deaerator apparatus 34 according to the preferred embodiment is based upon, i.e., equal to or higher than, the heightened amount of make-up water that is introduced from the demineralized water storage tank 28 during a power augmentation operating mode of the steam generating system 10, as discussed above.

It is also noted that under certain conditions, it may be desirable to measure the purity of the working fluid while little or none of the working fluid is passing through the sample points 38, 42, 44, 45, e.g., just prior to steam generating system start-up or when the condensate comprises an extremely contaminated purity, in which case the first and second pumps 18, 20 may be deactivated. During these conditions, the first valve 50 may be opened and the fourth pump 52 may pump condensate into the deaerator apparatus 34. The condensate may be sampled prior to entering the deaerator apparatus 34 at an auxiliary deaerator apparatus sample point 59 located between the condensate receiver tank 16 and the deaerator apparatus 34. The auxiliary deaerator apparatus sample point 59 may measure the purity, specific conductivity, hydrogen cation, exchanged conductivity, sodium, and silica of the condensate. If the condensate is found to have an undesirable purity, the condensate may be passed into the deaerator apparatus 34 where contaminates may be removed from the condensate, e.g., using steam from the auxiliary boiler 61. If the condensate is found to have a desirable purity, the condensate may be remain in the section of conduit 27A or may be allowed to flow back into the condensate receiver tank 16.

Once the condensate comprises the desirable purity, the fourth pump 52 is deactivated and the first valve 50 is closed to prevent the flow of the condensate from the condensate receiver tank 16 into the deaerator apparatus 34. At the conclusion of the first type of the non-typical operating state, the first and second pumps 18, 20 are activated and the working fluid, which now comprises the desirable purity, may flow through the through the remainder of the working fluid circuit. At the conclusion of the second type of the non-typical operating state, the steam turbine circumvent valve 56 is closed and the steam turbine 12, if previously deactivated, is activated and the second valve 55, if previously closed, is opened. Thus, the working fluid, which now comprises the desirable purity, may flow through the remainder of the working fluid circuit, including the steam turbine 12.

While it is contemplated that the deaerator apparatus 34 could be continuously run during the typical and non-typical operating states of the steam generating system 10, in a preferred embodiment the condensate only passes through the deaerator apparatus 34 during the non-typical operating state of the steam generating system 10, e.g., when the condensate comprises an undesirable purity. Thus, if the condensate is found to have an undesirable purity, as measured at one or more of the sample points 38, 42, 44, 45, 59, the deaerator apparatus 34 can be utilized to remove contaminants from the condensate to bring the condensate to a desirable purity.

The deaerator apparatus 34 is advantageous in power generating systems, such as the disclosed steam generating system 10, which include condensers that comprise an internal pressure that is maintained above ambient pressure, such as the condenser 140. For example, since the pressure maintenance system 60 substantially prevents contaminants from entering the condenser 140 during normal and non-normal operating modes, the deaerator apparatus 34 need not be run continuously during operation of the steam generating system 10. Accordingly, a cost of operating the deaerator apparatus 34 is reduced, as compared to prior art deaerator apparatus that are run continuously during operation of its steam generating system. Additionally, the deaerator apparatus 34 reduces the need for additional contaminant removal systems in the steam generating system 10, such as condensate polishers, which additional contaminant removal systems increase the cost of the steam generating system 10.

Figure 1A:
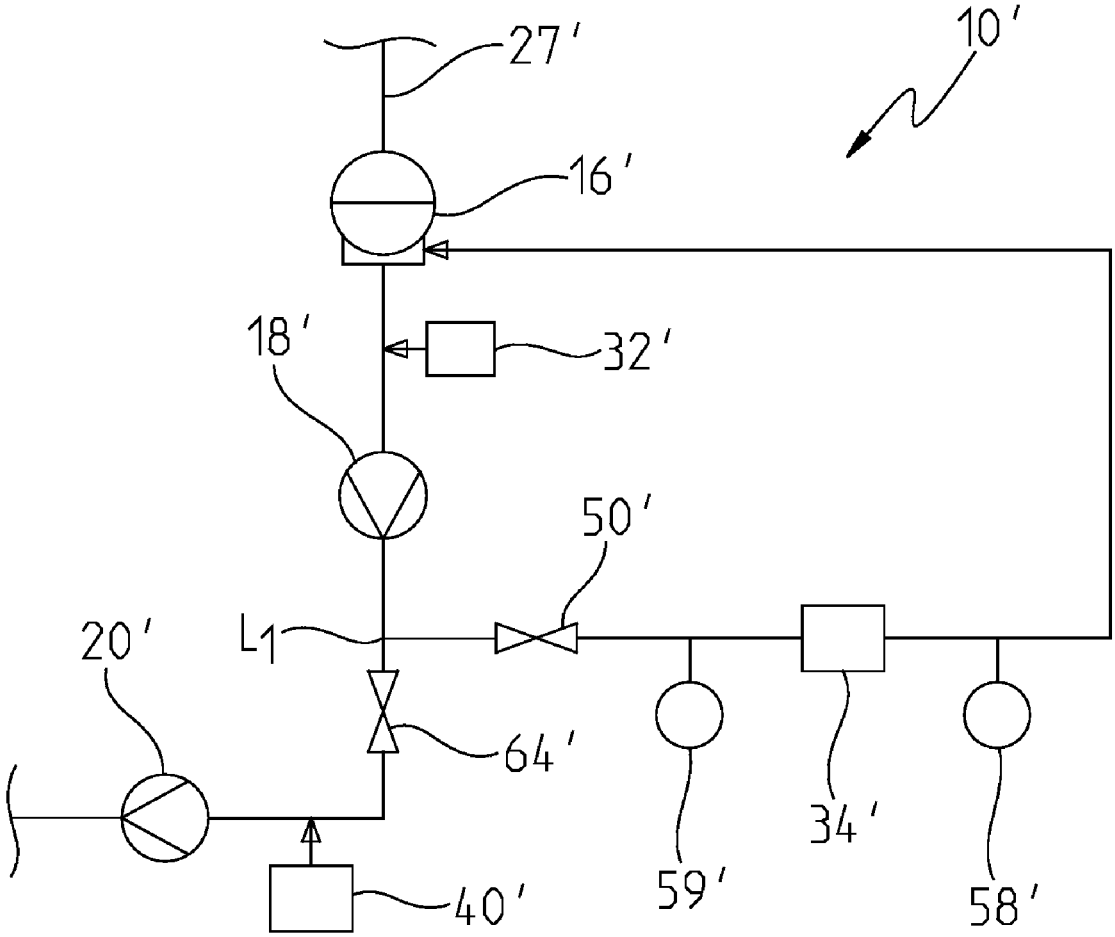
FIG. 1A is a diagrammatic illustration of a portion of a steam generating system in accordance with another embodiment of the invention.

Referring now to FIG. 1A, a first pump 18' is provided in a steam generating system 10' according to another embodiment of the invention, where the steam generating system 10' includes similar structure to the system 10 described above with reference to FIG. 1, and where elements of the system 10' similar to the system 10 of FIG. 1 are identified by the same reference number followed by a prime (') symbol. It is noted that structure illustrated in FIG. 1A followed by a prime (') symbol and not specifically referred to herein with reference to FIG. 1A is substantially similar to the corresponding structure discussed above with reference to FIG. 1. The first pump 18' is used in place of the first pump 18 with reference to FIG. 1 discussed above. The first pump 18' may have a large enough capacity to pump any desired condensate from a condensate receiver tank 16', through a first valve 50' and into a deaerator apparatus 34', in addition to pumping a working fluid along a working fluid circuit as described above with reference to FIG. 1. In this embodiment, the first valve 50' may be branched off from the working fluid circuit at a location $L_1$ downstream from the first pump 18'. A sixth valve 64' may be provided in the working fluid circuit downstream from the first pump 18', e.g., between the location $L_1$ and a second pump 20'. The first valve 50' can be opened/closed to permit/prevent condensate from flowing into the deaerator apparatus 34', and the sixth valve 64' can be opened/closed to permit/prevent the condensate from being pumped by the second pump 20' and on through the remainder of the working fluid circuit.

If the first pump 18' is used to pump any desired condensate through the first valve 50' and into the deaerator apparatus 34', the fourth pump 52 as described above with reference to FIG. 1 may be eliminated from the steam generating system 10'. In this embodiment, the first pump 18' may remain active during all operating states of the steam generating system 10', i.e., typical and non-typical operating states, including a first type of a non-typical operating state and a second type of a non-typical operating state, as described above with reference to FIG. 1. In the case of a first type of the non-typical operating state as described above, the sixth valve 64' may be closed and the remaining components located along the working fluid circuit may be deactivated, such that the working fluid is prevented from passing through the remainder of the working fluid circuit.

Figure 2:
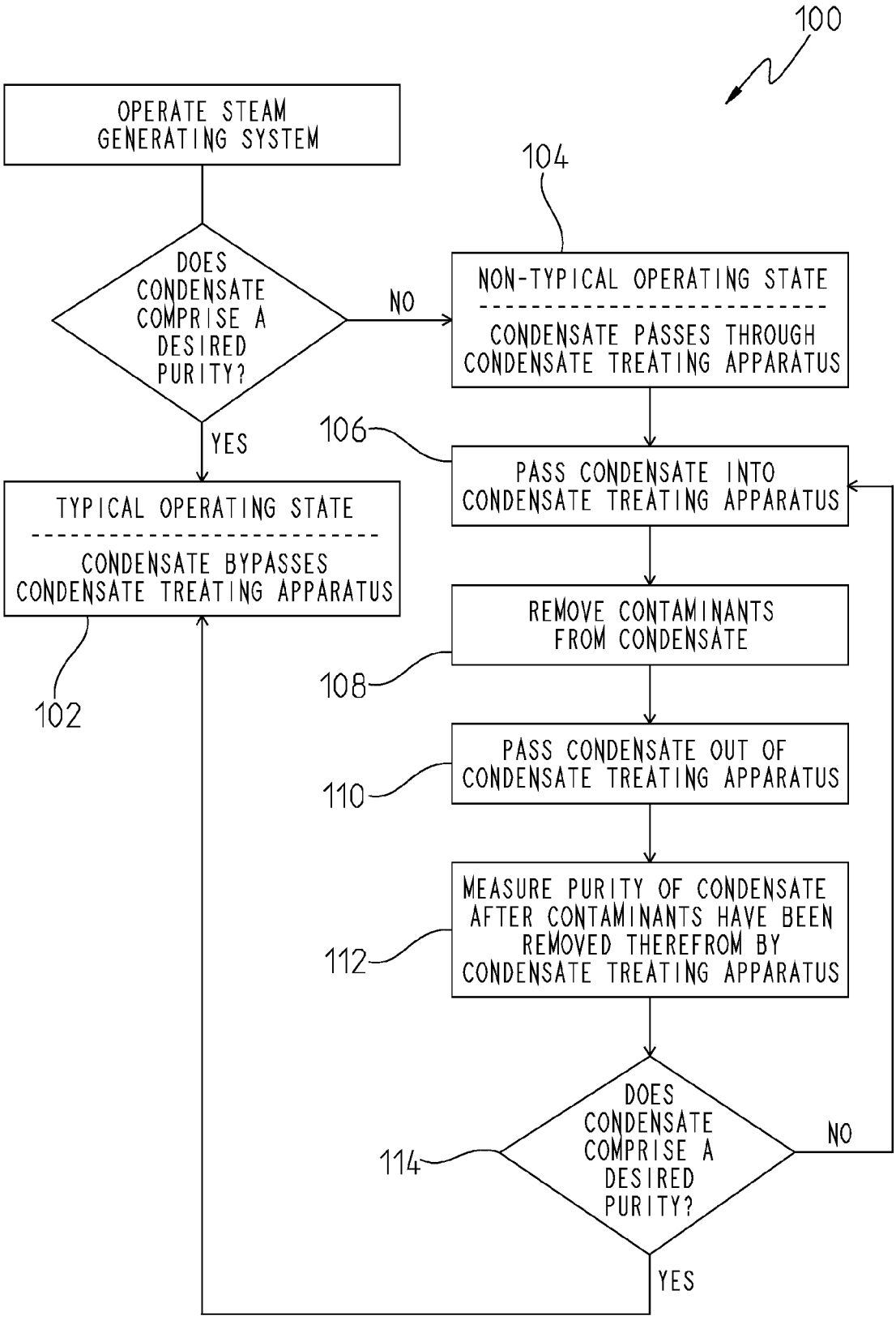
FIG. 2 is a flow chart illustrating steps for implementing a method in accordance with an embodiment of the invention.

FIG. 2 illustrates steps for implementing a method 100 of removing contaminants from the condensate with reference to the embodiment described above for FIGS. 1 and 1A, during a normal operating mode of the condenser 140. If the condensate comprises a desired purity, the condensate bypasses a condensate treating apparatus, such as the deaerator apparatus 34, during a typical operating state of the steam generating system 10 at step 102. If the condensate comprises an undesirable purity, the condensate is passed through the condensate treating apparatus during a non-typical operating state of the steam generating system 10 at step 104. Passing the condensate through the condensate treating apparatus comprises passing the condensate into the condensate treating apparatus at step 106, removing contaminants from the condensate at step 108, passing the condensate out of the condensate treating apparatus at step 110, and measuring a purity of the condensate after contaminants have been removed therefrom by the condensate treating apparatus at step 112. If the condensate still comprises an undesirable purity after passing through the condensate treating apparatus (step 114), the process returns to step 106 and the condensate is continually passed through the condensate treating apparatus until the condensate comprises a desirable purity at step 114. Once the condensate comprises the desired purity at step 114, the condensate bypasses the condensate treating apparatus during the typical operating state of the steam generating system 10 (step 102).

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A power generating system comprising:

a condenser that receives steam or a combination of water and steam and condenses the steam or combination of water and steam into a condensate, said condenser operating at an internal pressure above ambient pressure during a normal operating mode of said condenser;

a condensate treating apparatus that removes contaminants from said condensate to bring said condensate to a desirable purity, said condensate treating apparatus being deactivated during a typical operating state of the power generating system such that said condensate bypasses said condensate treating apparatus, and said condensate treating apparatus being activated during a non-typical operating state of the power generating system such that said condensate passes into said condensate treating apparatus wherein contaminants can be removed from said condensate, said typical operating state of the power generating system occurring when the condensate comprises said desirable purity and said non-typical operating state of the power generating system occurring when the condensate comprises an undesirable purity; and wherein, during a time in which said condenser operates in said normal operating mode at the internal pressure above ambient pressure, the power generating system operates in said non-typical operating state a first portion of the time and operates in said typical operating state a second portion of the time.

2. The power generating system as set out in claim 1, further comprising a condensate receiver tank that receives said condensate from said condenser.

3. The power generating system as set out in claim 2, wherein said condensate treating apparatus is branched off of said condensate receiver tank, and wherein said condensate is passed into said condensate receiver tank after contaminants are removed from said condensate in said condensate treating apparatus.

4. The power generating system as set out in claim 1, wherein said condensate treating apparatus comprises a deaerator apparatus.

5. The power generating system as set out in claim 4, further comprising a steam turbine, wherein steam from an outlet of said steam turbine is used by said deaerator apparatus to remove said contaminants from said condensate.

6. The power generating system as set out in claim 4, further comprising steam turbine and a steam source providing steam to said turbine, wherein at least a portion of said steam from said steam source circumvents said steam turbine and is used by said deaerator apparatus to remove said contaminants from said condensate.

7. The power generating system as set out in claim 1, further comprising:

a valve that controls a passage of said condensate into said condensate treating apparatus, an opening and a closing of said valve controlled by a controller; and a pump that pumps said condensate through said valve and into said condensate treating apparatus, an activation and deactivation of said pump controlled by said controller.

8. The power generating system as set out in claim 7, wherein said controller controls the opening and the closing of said valve and the activation and deactivation of said pump based on measurements received from at least one sample point.

9. A power generating system comprising:

a steam source;

a steam turbine;

a condenser that receives steam or a combination of water and steam and condenses the steam or combination of water and steam into a condensate, said condenser operating at an internal pressure above ambient pressure during a normal operating mode of said condenser;

a deaerator apparatus that uses steam from at least one of said steam source and said steam turbine to remove contaminants from said condensate to bring said condensate to a desirable purity, said deaerator apparatus being deactivated during a typical operating state of the power generating system such that said condensate bypasses said deaerator apparatus, and said deaerator apparatus being activated during a non-typical operating state of the power generating system such that said condensate passes into said deaerator apparatus wherein contaminants can be removed from said condensate, said typical operating state of the power generating system occurring when the condensate comprises a desirable purity and said non-typical operating state of the power generating system occurring when the condensate comprises an undesirable purity; and wherein, during a time in which said condenser operates in said normal operating mode at the internal pressure above ambient pressure, the power generating system operates in said non-typical operating state a first portion of the time and operates in said typical operating state a second portion of the time.

10. The power generating system as set out in claim 9, further comprising a condensate receiver tank that receives said condensate from said condenser, wherein said deaerator apparatus is branched off of said condensate receiver tank, and wherein said condensate is passed into said condensate receiver tank after contaminants are removed from said condensate in said deaerator apparatus.

11. The power generating system as set out in claim 9, further comprising:

a valve that controls a passage of said condensate into said deaerator apparatus, an opening and a closing of said valve controlled by a controller;

a pump that pumps said condensate through said valve and into said deaerator apparatus, an activation and deactivation of said pump controlled by said controller; and wherein said controller controls the opening and the closing of said valve and the activation and deactivation of said pump based on measurements received from at least one sample point.

12. The power generating system as set out in claim 9, wherein said steam source comprises an auxiliary boiler.

13. The power generating system as set out in claim 9, further comprising an inert gas source, wherein an inert gas from said inert gas source is used to assist in removing contaminants from said condensate to bring said condensate to a desirable purity.

14. A method of treating condensate that has been condensed in a condenser adapted for use within a steam generating system including a working fluid circuit, the condenser operating at an internal pressure above ambient pressure during a normal operating mode of the condenser, the method comprising:

bypassing the condensate past a condensate treating apparatus during a typical operating state of the steam generating system, the typical operating state occurring when the condensate comprises a desirable purity;

passing the condensate through the condensate treating apparatus during a non-typical operating state of the steam generating system, the non-typical operating state occurring when the condensate comprises an undesirable purity, wherein passing the condensate through the condensate treating apparatus comprises:

passing the condensate into the condensate treating apparatus;

removing contaminants from the condensate;

passing the condensate out of the condensate treating apparatus;

measuring a purity of the condensate after contaminants have been removed therefrom by the condensate treating apparatus; and continually passing the condensate through the condensate treating apparatus until the condensate comprises a desirable purity.

15. The method according to claim 14, wherein passing the condensate into the condensate treating apparatus comprises passing the condensate into a deaerator apparatus.

16. The method according to claim 15, wherein removing contaminants from the condensate comprises injecting steam into the deaerator apparatus, the steam effecting a removal of the contaminants from the condensate.

17. The method according to claim 16, wherein injecting steam into the deaerator apparatus comprises injecting steam from an outlet of a steam turbine of the steam generating system into the deaerator apparatus.

18. The method according to claim 16, wherein injecting steam into the deaerator apparatus comprises injecting steam from a steam source into the deaerator apparatus, wherein the steam from the steam source circumvents a steam turbine of the steam generating system on its way from the steam source to the deaerator apparatus.

19. The method according to claim 14, wherein passing the condensate into the condensate treating apparatus comprises passing the condensate from a condensate receiver tank into the condensate treating apparatus, the condensate receiver tank included in the working fluid circuit of the steam generating system.

20. The method according to claim 19, wherein the condenser receives the working fluid comprising steam from an outlet of a steam turbine in the working fluid circuit, and treated condensate flows from the condensate receiver tank through the working fluid circuit to an inlet of the steam turbine.

* * * * *